US011143373B2

(12) United States Patent
Ho

(10) Patent No.: US 11,143,373 B2
(45) Date of Patent: Oct. 12, 2021

(54) MOVABLE FLAME ASSEMBLY AND SIMULATED FLAME DEVICE COMPRISING THE SAME

(71) Applicant: MARS ALLIANCE INTERNATIONAL LTD., Hong Kong (CN)

(72) Inventor: Yu Fung Ho, Hong Kong (CN)

(73) Assignee: MARS ALLIANCE INTERNATIONAL LTD., Hong Kong (CN)

( * ) Notice: Subject to any disclaimer, the term of this patent is extended or adjusted under 35 U.S.C. 154(b) by 21 days.

(21) Appl. No.: 16/660,301

(22) Filed: Oct. 22, 2019

(65) Prior Publication Data

US 2021/0062988 A1 Mar. 4, 2021

(30) Foreign Application Priority Data

Aug. 28, 2019 (CN) ..... 201910801596.8

(51) Int. Cl.
*F21S 10/04* (2006.01)

(52) U.S. Cl.
CPC ..... *F21S 10/046* (2013.01); *F21S 10/043* (2013.01)

(58) Field of Classification Search
CPC ..... F21S 10/046; F21S 10/043
See application file for complete search history.

(56) References Cited

U.S. PATENT DOCUMENTS

| | | | | |
|---|---|---|---|---|
| 10,240,735 | B1 * | 3/2019 | Huang | F21S 10/04 |
| 2014/0218903 | A1 * | 8/2014 | Sheng | F21S 10/046 362/190 |
| 2016/0109083 | A1 * | 4/2016 | Li | F21K 9/00 362/84 |
| 2016/0116127 | A1 * | 4/2016 | Patton | F21S 6/001 362/284 |
| 2016/0298816 | A1 * | 10/2016 | Fang | F21S 10/046 |
| 2017/0089548 | A1 * | 3/2017 | Yang | F21L 4/02 |
| 2017/0311404 | A1 * | 10/2017 | Li | H05B 47/105 |
| 2018/0010750 | A1 * | 1/2018 | Cheng | G02B 6/0008 |
| 2019/0003686 | A1 * | 1/2019 | Dong | F21V 19/0025 |

* cited by examiner

*Primary Examiner* — Kristina N Junge
(74) *Attorney, Agent, or Firm* — Harness, Dickey & Pierce, P.L.C.

(57) ABSTRACT

The present invention relates to a movable flame assembly comprising: a simulated flame element; a transmission element for disposing and actuating the simulated flame element; an elastic element directly or indirectly connected to the simulated flame element and supporting the simulated flame element and the transmission element; and a power source for driving the transmission element. The invention further relates to a simulated flame device comprising the movable flame assembly.

13 Claims, 5 Drawing Sheets

MOVABLE FLAME ASSEMBLY AND SIMULATED FLAME DEVICE COMPRISING THE SAME

CROSS-REFERENCE TO RELATED APPLICATIONS

This application claims the benefit and priority of Chinese Patent Application No. 201910801596.8, filed Aug. 28, 2019. The entire disclosure of the above application is incorporated herein by reference.

FIELD OF THE INVENTION

The present invention generally relates to a movable flame assembly and a simulated flame device comprising the same, and more particularly to a simulated flame device with a dynamic flame visual effect.

BACKGROUND

Candlelight is often needed in daily life to create an ambient on the occasions such as weddings, gatherings of friends, and birthday celebrations, or in the places such as restaurants, bars, churches, and cafes, for rendering a romantic atmosphere. However, traditional candles are very inconvenient for use, for the reason of their high-temperature flame, which increases the concentration of carbon dioxide in the air. Furthermore, they have a short burning duration and low utilization rate of resource, not complying with the current requirement for energy saving or being environmentally friendly. In addition, there are great safety hazards for traditional candles, such as a possibility of causing a fire that may lead to an incalculable loss of life and property. Nowadays, artificial and simulated flame devices with a simulated flame are increasingly popular and are very welcome.

However, most of the electronic candles commercially available have a fixed simulated flame, with an effect merely similar to a lighting device of a flame shape, not being able to produce a dynamic candlelight effect of a natural flame at all, or to create the desired romantic ambient, neither.

In order to produce a dynamic effect, current electronic candle lamps usually simulate the candle flame by projecting light onto a reflective sheet (namely a reflective sheet is provided as a reflection carrier on the top of the electronic candle lamp) to imitate the dynamic effect by swinging the reflective sheet. Such electronic candle lamps, however, usually have a number of disadvantages. In an electronic candle that enables the reflective sheet to swing to imitate a dynamic effect, the swing of the reflective sheet caused by the transmission structure are relatively regular, similar to the swing of a pendulum in a plane, which is extremely boring, making it impossible to imitate an irregular, vivid, dynamic effect of a natural drift of the candlelight or create the desired atmosphere. Moreover, due to the provision of a reflective sheet, the angle for observing such an electronic candle lamp is also largely limited, and the effect of a flame cannot be observed at all positions over 360 degrees around the electronic candle lamp. For example, the effect of a complete flame cannot even be observed by a user located at the lateral positions of the reflective sheet.

Other electronic candle lamps produce a dynamic effect by moving the light that is projected onto the simulated flame. However, such electronic candle lamps that move the projected light can only produce an illumination effect that the light itself flashes in the simulated flame, but the simulated flame itself does not move, and therefore cannot imitate an irregular, dynamic effect of a natural drift of the candlelight, or create the desired atmosphere.

Moreover, the existing electronic candle lamps with dynamic effects are generally very complex in structure, which results in a relatively complex manufacturing, thus leading to a relatively high cost.

SUMMARY

It is an object of the invention to provide an improved simulated flame device that overcomes or mitigates one or more of the disadvantages of the prior art as mentioned above.

According to one aspect of the invention, a movable flame assembly is provided, comprising: a simulated flame element; a transmission element for disposing and actuating the simulated flame element; an elastic element directly or indirectly connected to the simulated flame element and supporting the simulated flame element and the transmission element; and a power source for driving the transmission element.

The invention provides a movable flame assembly that can achieve a more natural dynamic visual effect that a flame moves more naturally with the wind.

According to one aspect of the invention, the simulated flame element is 3D.

Thus, the invention provides a simulated flame device that is more expressive and ornamental. The viewing thereof is not limited by the angle at which the observer is located. The natural movement of the simulated flame element can be enjoyed in all directions around the simulated flame.

According to one aspect of the invention, the elastic element is a spring.

The simulated flame element and the transmission element supported by the elastic element can move more irregularly, due to the interaction of the elasticity of the elastic element, the gravity of the simulated flame element and of the transmission element, and the driving of the power source.

According to one aspect of the invention, the power source can output power at a power and/or frequency and/or direction that can be variable over time, such that the movement of the transmission element driven thereby is more irregular.

Since the power is output at a time-varying power, the vibration amplitude of the transmission element changes continuously over time and may be superposed with the previous movements to various degrees, thereby at least resulting in the amplitude of the movement of the elastic element and the simulated flame element to change continuously accordingly.

Since the power is output at a time-varying frequency, the vibration frequency of the transmission element changes continuously over time and may be superposed with the previous movements to various degrees, thereby at least resulting in the frequency of the movement of the elastic element and the simulated flame element to change continuously accordingly.

Since the power is output in a time-varying direction, the vibration direction of the transmission element changes continuously, thereby at least applying a force to the elastic element in different directions, causing deformation of the elastic element in different directions, and at least resulting in the movement of the elastic element and the simulated flame element to change continuously accordingly.

According to one aspect of the invention, the transmission element comprises at least one horizontal balance sheet or balance bar. According to other embodiments of the invention, the transmission element is a tapered element that tapers toward the simulated flame element.

At rest, an assembly comprising the simulated flame element, the transmission element and the elastic element keep balance therebetween. When the assembly is driven, the transmission element leads to an irregular movement of the elastic element and the simulated flame element.

Moreover, due to the transmission element and the spring in the invention, the mechanism for realizing an irregular movement of the simulated flame element is relatively simple and easy to manufacture.

According to one aspect of the invention, the power source comprises a motor having a power output shaft, which drives the transmission element to thereby cause movement of the simulated flame element.

According to one aspect of the invention, the power source includes a coil and a magnet, wherein the magnet is disposed on the transmission element such that an electromagnetic force generated by the coil and the magnet drives the transmission element to thereby cause movement of the simulated flame element.

According to one aspect of the invention, the power source comprises a gas flow generating mechanism, a gas flow generated by which drives the transmission element to thereby cause movement of the simulated flame element.

The invention also provides a simulated flame device including the aforementioned movable flame assembly, the simulated flame device further including: a housing defining a cavity and having an aperture at the top, wherein the movable flame assembly is located within the cavity, and the simulated flame element extends out of the aperture; and at least one light source located within the cavity to illuminate the simulated flame element.

According to one aspect of the invention, the simulated flame device further includes in the cavity: a bracket including a support for supporting the movable flame assembly; an electronic means for controlling the simulated flame device; and a base that can house at least a portion of a power supply assembly and the electronic means.

According to one aspect of the invention, the electronic means may be configured to achieve at least a function selected from the group consisting of: intelligent switching, timing, adjusting brightness and/or color of the light source and remotely controlling the simulated flame device.

By means of the electronic means, electrical connections and various control functions within the simulated flame device can be achieved.

According to one aspect of the invention, the at least one light source comprises a plurality of light sources uniformly distributed in a circumferential direction of the simulated flame element, wherein:

the at least one light source projects light directly onto the simulated flame element; or the simulated flame device further includes at least one reflector within the cavity, the reflector reflecting light emitted by the at least one light source onto the simulated flame element, wherein the reflector may be fixed or movable.

According to one aspect of the invention, the power supply assembly may comprise a battery(s) and/or be connected to an external power source.

According to one aspect of the invention, the simulated flame device is an electronic candle or electronic torch.

The simulated flame device according to the invention can exhibit a more vivid, more natural, dynamic flame effect, due to the obviously more irregular movement of the simulated flame element.

The invention advantageously provides a simulated flame device with a low-cost and a simple structure.

BRIEF DESCRIPTION OF THE DRAWINGS

The disclosure of the invention will be more readily understood with reference to the accompanying drawings. It is to be understood that the drawings are only for the purpose of illustration, and not intended to limit the protection scope of the invention. In the drawings.

DETAILED DESCRIPTION OF EMBODIMENTS

Figure 1:
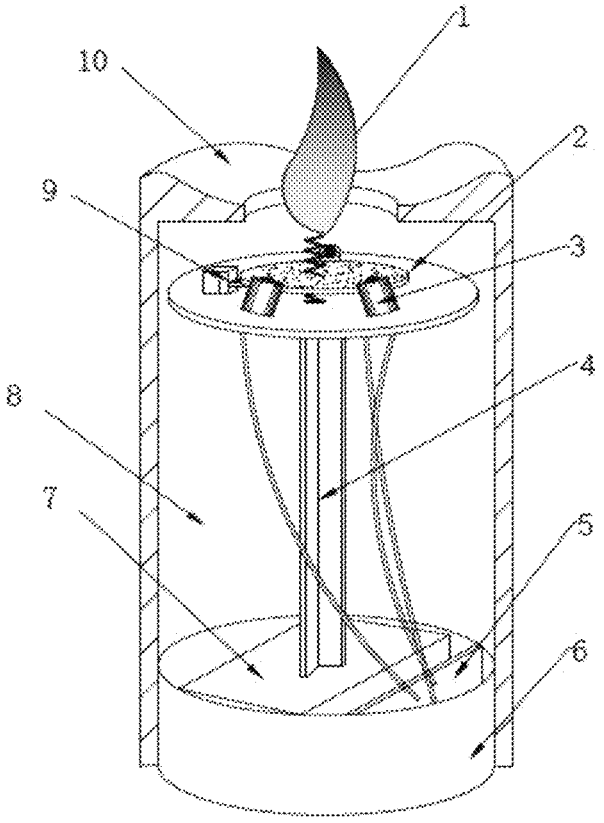
FIG. 1 is a schematic view of a simulated flame device according to one embodiment of the invention.

Some specific embodiments of the invention will be described in details below with reference to the accompanying drawings. Throughout the drawings, the same reference numerals indicate the same or the corresponding components or parts.

Figure 2:
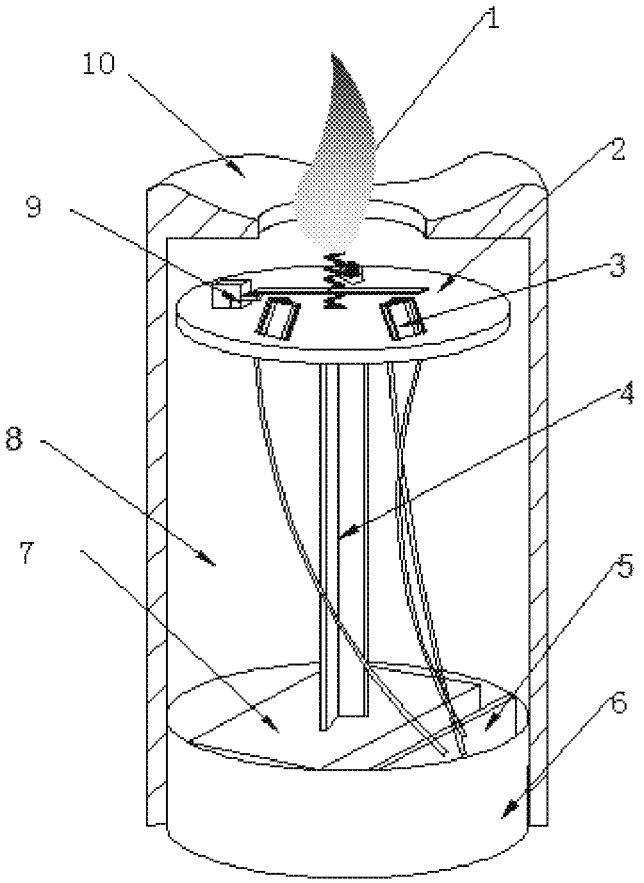
FIG. 2 is a schematic view of a simulated flame device according to another embodiment of the invention.

Referring to FIGS. 1-10, the invention provides a simulated flame device. FIGS. 1 and 2 schematically illustrate simulated flame devices in accordance with different embodiments of the invention. The simulated flame device may be an electronic candle, an electronic torch, and any other similar simulated lighting devices. The following description takes an electronic candle as an example, but the present invention is not limited to it.

As shown in FIGS. 1 and 2, the simulated flame device includes a housing 10 defining a cavity 8, a base 6 fixed within the cavity 8, and a bracket 4 including a support 2 for supporting a movable flame assembly. The housing 10 is provided with an aperture at the top center. At least one light source 3 is also arranged on the support 2 to illuminate the simulated flame element 1. The simulated flame device may further include an electronic means 5. The electronic means 5 may be partially housed in the base 6 and configured to control the simulated flame device. Other electrical elements, such as the power supply assembly 7, may also be housed in the base 6. The power supply assembly 7 is electrically connected with at least one light source 3, for example by cables. The electronic means 5 is communicably connected to the power supply assembly 7 and/or the light source 3 to control the power supply assembly 7 and/or the light source 3.

Figure 3:
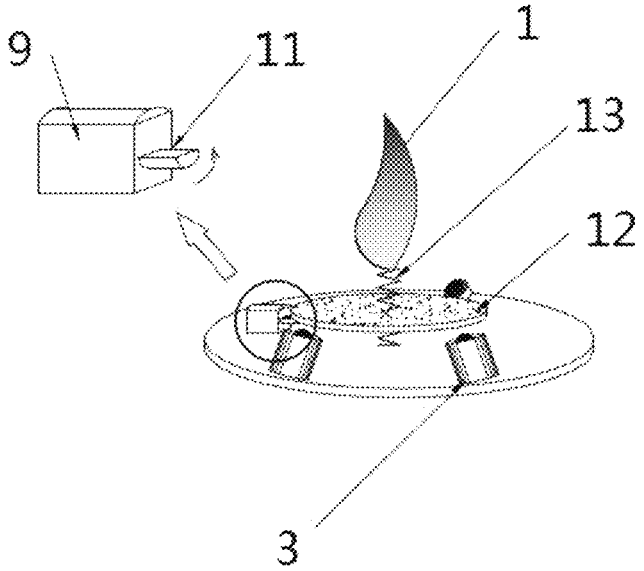
FIG. 3 is a schematic view of a movable flame assembly according to one embodiment of the invention, wherein the power source comprises a motor.

FIGS. 3-6 schematically illustrate different embodiments of a movable flame assembly. The movable flame assembly is supported on the fixed support 2. As shown in FIG. 3, a movable flame assembly according to an embodiment of the invention includes a simulated flame element 1, a transmission element 12, an elastic element 13, and a power source 9. The simulated flame element 1 extends out of the aperture at the top of the housing to imitate the effect of a true flame. The simulated flame element 1 is connected at the bottom to the elastic element 13, which passes through and is connected to the transmission element 12. The transmission element 12 is driven by the power source 9 to actuate the elastic member 13 and the simulated flame element 1.

In the embodiment shown in FIG. 3, the power source 9 comprises one or more motors including a power output shaft 11. A portion (e.g., an edge portion) of the transmission element 12 is in contact with, but no fixed to, the corresponding power output shaft 11. When the power output shaft 11 is stationary, the assembly comprising the transmission element 12, the elastic element 13 and the simulated flame element 1 keep balanced; and when the power output shaft 11 is rotated (for example, in the direction indicated by the arrow in FIG. 3, but not limited thereto), since the power output shaft 11 is in contact with a portion of the transmission element 12, the power output shaft 11 applies a force to the transmission element 12, causing a movement of the transmission element 12, and thereby leading to a movement of the elastic member 13 connected with the transmission element 12 and of the simulated flame element 1.

The power source 9 may output power at a power varying over time such that the force acting on the transmission element 12 varies over time. The power source 9 may output power at a frequency varying over time such that the transmission element 12 is driven at different frequencies. The power source 9 may constantly switch the direction of movement such that the transmission element 12 is driven in different directions. Preferably, the power output of the power output shaft 11 may be controlled with a controller such that it exhibits a completely irregular motion. The term "irregular" herein means that an ordinary observer generally cannot perceive any regularity sensually or intuitively.

Hence, the power output shaft 11 may rotate within the amplitudes of a relatively small scale at different powers/frequencies/directions, and the transmission element 12 actuates the elastic element 13 and the simulated flame element 1 at different powers and/or frequencies and/or directions accordingly. The elastic element 13 exhibits a more irregular deformation, due to the superposition of a plurality of the effects generated by the irregularity of the power output by the power source 9, the gravity of the transmission element 12 itself, and the elasticity and gravity of the elastic element 13. Further, the interaction between the force applied by the elastic element 13 to the simulated flame element 1 and the gravity of the simulated flame element 1 also causes the simulated flame element 1 to move in a more irregular manner.

The simulated flame in the prior art can only swing in a plane like a pendulum, and the swing tends to be regular. In contrast, the movement of the simulated flame element 1 in the invention is not limited to be in a single plane. Rather, the simulated flame element 1 can move irregularly in a plurality of planes around itself without a fixed direction and at varying amplitude, and therefore imitate a true dynamic effect that a real flame flutters and sways along with the wind.

The power output shaft 11 may be semi-cylindrical, and its upper surface may be flat to contact with a portion of the transmission element 12 so as to drive the transmission element 12.

Figure 4:
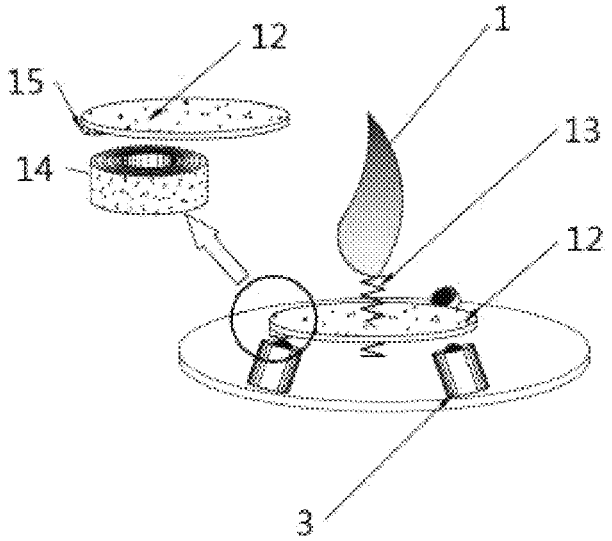
FIG. 4 is a schematic view of a movable flame assembly according to one embodiment of the invention, wherein the power source comprises a coil and a magnet.

In FIG. 4, the implementation of the power source 9 is different from that in FIG. 3, but the principle of irregular movement of the elastic element 12 and the simulated flame element 1 caused by the transmission element 12 is substantially the same as described in connection with FIG. 3. The power source 9 may drive the transmission element 12 by means of an electromagnetic force. Specifically, the power source 9 may include a coil 14 disposed on the support 2 and a magnet 15 disposed on a bottom surface of the transmission element 12. When the coil 14 is energized, the electromagnetic force generated between the coil 14 and the magnet 15 drives the transmission element 12. The magnet 15 may be a ferromagnet or any other magnetizable member.

Preferably, the current in the coil 14 may be controlled with a controller such that the magnitude and/or frequency and/or direction of the generated electromagnetic force is variable, thereby causing the amplitude and/or direction of the movement of the transmission element 12 to vary. This in turn causes a very irregular movement of the simulated flame element 1.

Likewise, the simulated flame element 1 moves in a more irregular manner, due to the superposition of a plurality of the effects generated by: the irregularity of the power output by the power source 9, the gravity of the transmission element 12, the elasticity and the gravity of the elastic element 13, and the gravity of the simulated flame element itself.

Figure 6:
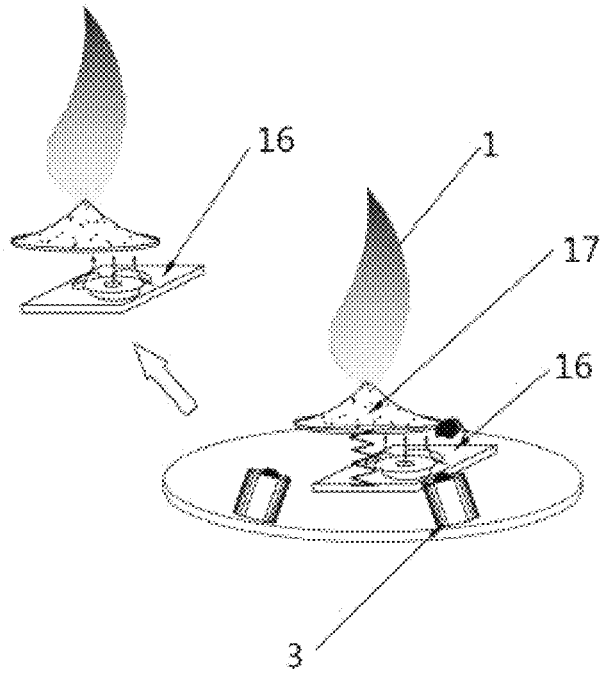
FIG. 6 is a schematic view of a movable flame assembly according to one embodiment of the invention, wherein the power source comprises a gas flow generating mechanism.

Another embodiment of the power source 9 is shown in FIG. 6. The power source 9 may include a gas flow generating mechanism 16 disposed on the support 2, which can generate a gas flow toward the simulated flame element 1 and/or the transmission element 12, and the generated gas flow can drive the simulated flame element 1 and/or the transmission element 12 to move.

Preferably, the magnitude and/or frequency and/or direction of the gas flow generated by the gas flow generating mechanism 16 may be controlled with a controller such that the amplitude and/or direction of movement of the simulated flame element 1 and/or the transmission element 12 is also variable, thereby causing a very irregular movement of the simulated flame element 1. Optionally, the gas flow generating mechanism 16 is a fan.

Likewise, the simulated flame element 1 moves in a more irregular manner, due to the superposition of a plurality of the effects generated by: the irregularity of the power output by the power source 9, the gravity of the transmission element 12, the elasticity and the gravity of the elastic element 13, and the gravity of the simulated flame element itself.

Figure 5:
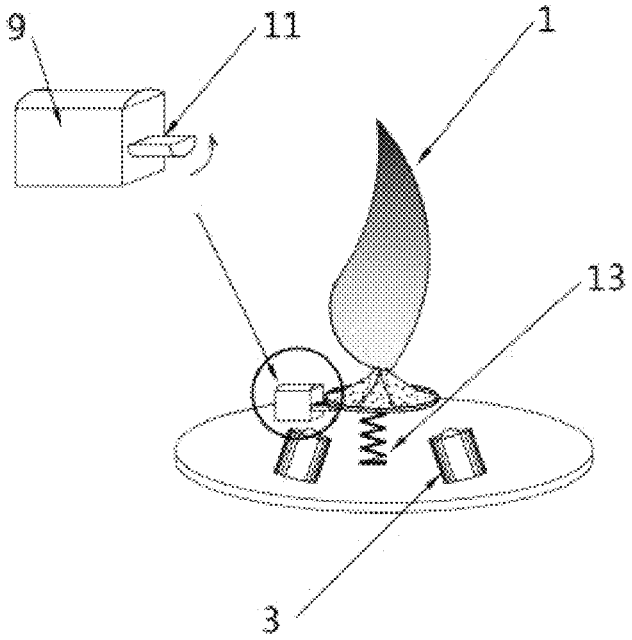
FIG. 5 is a schematic view of a movable flame assembly according to one embodiment of the invention, wherein the transmission element is a tapered element.

Different embodiments of the transmission element 12 are also shown in FIGS. 1-6. The transmission element 12 is configured such that it is easy to maintain the balance of the assembly comprising the transmission element 12, the elastic member 13 and the simulated flame element 1 when stationary, and easy to actuate the elastic element 13 and the simulated flame member 1 during movement of the transmission element 12. In some embodiments, as shown in FIGS. 1, 3, and 4, the transmission element 12 may be a horizontal balance sheet, which can be in the form of a disk or any other suitable form. The transmission element 12 may also be a horizontal balance bar, as shown in FIG. 2. A portion of the balance sheet or balance bar may contact with the flat surface of the power output shaft 11, and the elastic element 13 passes through and is connected to the balance sheet or the balance bar. Preferably, the elastic element 13 passes through the center of the balance sheet or the balance bar. In other embodiments, as shown in FIGS. 5 and 6, the transmission element 12 may be a substantially tapered element 17 that tapers toward the simulated flame element 1. The tapered element 17 may be connected at the tapering top to the simulated flame element 1 and connected at the bottom to the elastic element 13. In some embodiments, it is not necessary for the transmission element 12 to contact with the power source 9.

Preferably, the simulated flame element 1 may be three-dimensional (3D). Since the simulated flame element 1 is 3D, the viewing angle around the simulated flame device is not limited. A natural, vivid candlelight effect can be enjoyed at all directions around the simulated flame device. The simulated flame element 1 may have any suitable size and shape.

In some embodiments, the elastic element 13 may be a spring. More specifically, the elastic element 13 may be a coil spring. The stiffness of the elastic element 13 may be selected to be suitable for balancing the weight of the simulated flame element 1 and the transmission element 12 when at stationary. The elastic element 13 may be fixedly connected at the lower end to the support 2. The elastic element may be connected at the upper end to the simulated flame element 1 or the transmission element 12. As shown in FIGS. 3 and 4, the upper end of the elastic element 13 may be directly connected to the simulated flame element 1. Further, the elastic element 13 passes through and is connected to the transmission element 12. As shown in FIGS. 5 and 6, the simulated flame element 1 may also be indirectly connected to the elastic element 13 by means of the transmission element 12.

In some embodiments, the light source 3 may include at least two light sources uniformly disposed in a circumferential direction of the simulated flame element. The light source 3 is electrically connected to the power supply assembly 7 to illuminate the simulated flame element 1. The light source 3 may be an LED light or any other suitable light source. The at least two light sources may emit light having the same or different colors and/or brightness. Preferably, the number of light sources may be 3 to 6.

Figure 7:
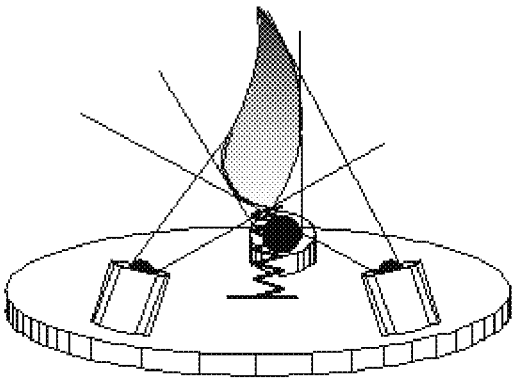
FIG. 7 is a schematic view of projecting light onto the simulated flame element.

When comprising a plurality of light sources, the light emitted by the plurality of light sources complements or overlaps with each other on the simulated flame element. As shown in FIG. 7, the three light sources 3 are uniformly distributed in the circumferential direction of the simulated flame element 1 at an angle of 120° relative to one another.

In some embodiments, the brightness and/or color of the light source 3 are adjustable and/or variable. Preferably, the brightness and/or color of the light source can be set by means of a controller, for example automatically or manually by the user.

Figure 8:
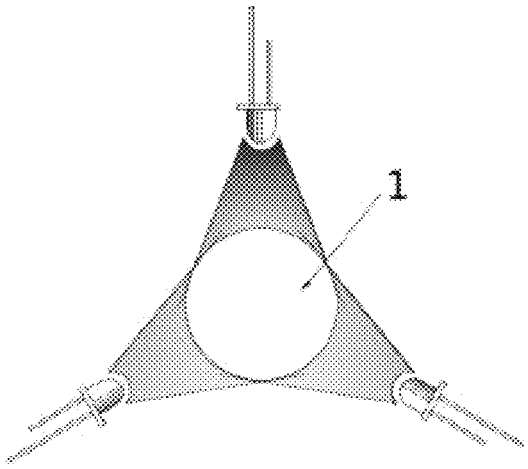
FIG. 8 is a schematic top view of projecting light onto the simulated flame element.

As shown in FIG. 8, the at least one light source 3 may be oriented towards the simulated flame element 1 and may project light directly onto the simulated flame element. The three light sources 3, which are uniformly distributed in the circumferential direction, project light directly onto the simulated flame element 1. Light reflected by the simulated flame element is re-emitted into the eyes of the surrounding observer, allowing the observer to observe a vivid candlelight effect at any angle around the simulated flame device.

Figure 9:
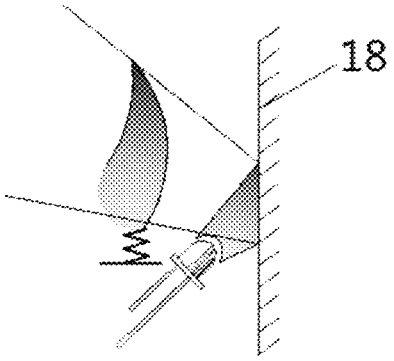
FIG. 9 is a schematic view of reflecting light from one light source onto the simulated flame element by means of a reflector according to another embodiment of the invention.
Figure 10:
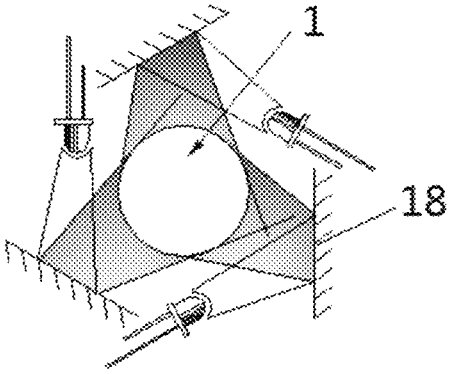
FIG. 10 is a schematic view of reflecting light from three light sources onto the simulated flame element by means of a reflector according to yet another embodiment of the invention.

As shown in FIG. 9, the simulated flame device may also include at least one reflector 18. The reflector may be disposed on the inner wall of the cavity 8 or at any suitable location. The light source 3 is oriented at a suitable angle towards the reflector such that the light it emits is reflected by the reflector onto the simulated flame element 1. In some embodiments, the number of the reflectors may correspond to the number of the light sources. The reflector 18 and the light source 3 may each be oriented such that light emitted by the light source is reflected by the reflector 18 and then projected onto the simulated flame element 1. As shown in FIG. 10, the light emitted by three uniformly distributed light sources is respectively reflected by three reflectors and then projected onto the simulated flame element 1. The reflector may be fixed. Alternatively, the reflector may be movable. The reflector 18 may be in the form of a reflective sheet or any other suitable form.

Further, the light effect at different locations on the simulated flame element 1 is produced by the superposition of light from light sources of different orientations. Due to the superposition of light and the irregular movement of the simulated flame element, the simulated flame element 1 produces a more flickering, erratic, romantic candlelight effect.

Further, in the case where a movable reflector 18 is included, on the basis of the aforementioned effect, the flickering, erratic, romantic light effect of the simulated flame element 1 is more significant, due to the further superposition of the movement of the reflector.

Referring again to FIGS. 1 and 2, the electronic means 5 may also include one or more controllers (not shown in detail in the drawings) to achieve one or more intelligent control functions of the simulated flame device. The one or more controllers may be programmed for setting according to user needs. Optionally, the electronic means 5 is configured for intelligent switching, timing, or adjusting the brightness and/or color of the light source. Preferably, the simulated flame device may be controlled remotely by means of the electronic means. The electronic means may include a printed circuit board (often referred to as a PCB) and/or any other suitable electronic component.

The electronic means 5 also includes a controller for controlling the power source 9 such that the power source 9 outputs power at an irregular power and/or frequency and/or direction. The controller is communicably connected to the power source 9 to transmit signals to and/or receive signals from the power source 9 in a wired or wireless manner.

The power supply assembly 7 of the simulated flame device may include at least one battery. The battery may be disposed at any suitable location within the cavity 8, such as in the base 6. Optionally, the simulated flame device may be connected to an external power source, for example, by providing a USB interface or a power plug or through any other suitable interface.

In addition, the housing 10 of the simulated flame device may also be provided with various switches, buttons, knobs and other components according to user needs. For example, a mechanical switch may be provided at the bottom of the housing 10 to turn the simulated flame device on or off.

In view of the fact that the simulated flame device according to the invention provides a more natural, flickering, dynamic candlelight effect and creates a very satisfying romantic atmosphere, it is ideal for use in weddings, gatherings of friends, birthday celebrations, or in places such as restaurants, bars, churches and cafes. Moreover, in the case where a plurality of simulated flame devices according to the invention is arranged at the same time, the effect of alternating light and shadow is more remarkable.

Although each embodiment has been described above as having some specific features, one or more of those features described in relation to any embodiment of the invention may be substituted by and/or combined with any feature of the other embodiments, even if the combination is not explicitly described. In other words, the described embodiments are not mutually exclusive, and substitution of one or more embodiments or features with the other are still within the scope of the invention.

The technical scope of the invention is not limited to the above description. Those skilled in the art can make various modifications and changes to the above embodiments without departing from the inventive concept of the invention, and these modifications and changes should all be within the scope of the invention.

LIST OF THE REFERENCE NUMERALS

1 Simulated flame element
2 Support
3 Light source
4 Bracket
5 Electronic means
6 Base
7 Power assembly
8 Cavity
9 Power source
10 Housing
11 Power output shaft
12 Transmission element
13 Elastic element
14 Coil
15 Magnet
16 Gas flow generating mechanism
17 Tapered element
18 Reflector

The invention claimed is:

1. A movable flame assembly comprising:
a simulated flame element;
a transmission element for disposing and actuating the simulated flame element;
an elastic element directly or indirectly connected to the simulated flame element and supporting the simulated flame element and the transmission element, wherein the elastic element passes through and is connected to the transmission element; and
a power source for driving the transmission element, the power source including a power output shaft being in contact with, but not fixed to, a portion of the transmission element such that when the power output shaft is rotated irregularly, the power output shaft irregularly applies a force to the transmission element, causing a movement of the transmission element, and thereby leading to a movement of the elastic element connected with the transmission element and of the simulated flame element,
wherein the simulated flame element is three-dimensional and configured to be viewed around a circumference of the simulated flame element.

2. The movable flame assembly according to claim 1, wherein the elastic element is a spring.

3. The movable flame assembly according to claim 1, wherein the power source is configured to output power at different powers and/or different frequencies and/or different directions such that a movement of the transmission element driven thereby is more irregular.

4. The movable flame assembly according to claim 1, wherein the transmission element comprises at least one horizontal balance sheet or balance bar, or the transmission element is a tapered element that tapers toward the simulated flame element.

5. The movable flame assembly according to claim 4, wherein the power source further comprises a motor operable to rotate the power output shaft.

6. The movable flame assembly according to claim 4, wherein the power source includes a coil and a magnet, wherein the magnet is disposed on the transmission element such that an electromagnetic force generated by the coil and the magnet drives the transmission element to thereby cause movement of the simulated flame element.

7. The movable flame assembly according to claim 4, wherein the power source comprises a gas flow generating mechanism, and a gas flow generated by the gas flow generating mechanism drives the transmission element to thereby cause movement of the simulated flame element.

8. A simulated flame device comprising the movable flame assembly of claim 1, the simulated flame device further comprising:
a housing defining a cavity and including an aperture at the top of the housing, the movable flame assembly being located within the cavity, and the simulated flame element extending out of the aperture; and
at least one light source located within the cavity to illuminate the simulated flame element.

9. The simulated flame device according to claim 8, further including in the cavity:
a bracket comprising a support for supporting the movable flame assembly;
an electronic controller for controlling the simulated flame device; and
a base configured to house at least of portion of a power supply assembly and the electronic controller.

10. The simulated flame device according to claim 9, wherein the electronic controller is configured to perform a function selected from the group consisting of: intelligent switching, timing, adjusting brightness and/or color of the light source, and remotely controlling the simulated flame device.

11. The simulated flame device according to claim 8, wherein the at least one light source comprises a plurality of light sources uniformly distributed in a circumferential direction of the simulated flame element, wherein:
the at least one light source projects light directly onto the simulated flame element; or
the simulated flame device further includes at least one reflector within the cavity, the at least one reflector reflecting light emitted by the at least one light source onto the simulated flame element.

12. The simulated flame device according to claim 9, wherein the power supply assembly comprises a battery and/or is connected to an external power source.

13. The simulated flame device according to claim 8, wherein the simulated flame device is an electronic candle or electronic torch.

* * * * *